United States Patent [19]

Dlugokecki

[11] Patent Number: 5,062,776

[45] Date of Patent: Nov. 5, 1991

[54] COMMUTATOR FOR ORBITING GEROTOR-TYPE PUMPS AND MOTORS

[75] Inventor: Andrew N. Dlugokecki, Bridgton, Me.

[73] Assignee: Parker Hannifin Corporation, Cleveland, Ohio

[21] Appl. No.: 389,657

[22] Filed: Aug. 4, 1989

[51] Int. Cl.[5] ..... F03C 2/08; F04C 2/10

[52] U.S. Cl. ..... 418/61.3

[58] Field of Search ..... 418/61.3

[56] References Cited

U.S. PATENT DOCUMENTS

| | | | |
|---|---|---|---|
| 3,453,966 | 7/1969 | Eddy | 418/61.3 |
| 3,512,905 | 5/1970 | Waldorff | 418/61.3 |
| 4,380,420 | 4/1983 | Wösthof et al. | 418/61.3 |
| 4,457,677 | 7/1984 | Todd | 418/61.3 |
| 4,697,997 | 10/1987 | White, Jr. | 418/61.3 |
| 4,877,383 | 10/1989 | White, Jr. | 418/61.3 |

FOREIGN PATENT DOCUMENTS

| | | | |
|---|---|---|---|
| 3327772 | 2/1985 | Fed. Rep. of Germany | 418/61.3 |

*Primary Examiner*—John J. Vrablik

*Attorney, Agent, or Firm*—Christopher H. Morgan

[57] ABSTRACT

An improved commutator for a gerotor-type hydraulic pump or motor of the type having an orbiting outer or inner gear. Such pumps or motors require a commutator having a circular array of alternating inlet and outlet openings adjacent to a rotating valve plate which regulates flow to the gerotor gears. The commutator of the present invention has a chambers section and a fluid pathways section. The chambers section has a radially inner and a radially outer chamber disposed therein radially beneath the inlet port and outlet port of the pump or motor, also disposed in the chambers section. The radially outer chamber and radially inner chamber are each connected to one of the inlet and outlet ports. The pathways sections has the circular array of alternating inlet and outlet openings therein and includes fluid pathways which connect these inlet and outlet openings, respectively, to one of the radially inner and radially outer chambers of the chambers section.

12 Claims, 4 Drawing Sheets

COMMUTATOR FOR ORBITING GEROTOR-TYPE PUMPS AND MOTORS

BACKGROUND OF THE INVENTION

1. Field of the Invention

The present invention relates in general to hydraulic pumps and motors and more particularly to such hydraulic pumps and motors having gerotor type gears.

2. Description of the Prior Art

Gerotor type pumps and motors are well known to those skilled in the art of hydraulic equipment. Gerotor pumps and motors utilize a set of gears the outer of which has teeth which face inwardly and the inner of which has teeth which face outwardly. The size, positioning, and arrangement of the teeth is such that hydraulic fluid cavities between the teeth open and close as the gears engage and rotate. This flow of hydraulic fluid can drive the rotation of a shaft connected to one of the gears (a motor) or can be driven by the shaft rotation (a pump). Gerotor pumps and motors are described in U.S. Pat. Nos. 4.501,536; 4,545,748; and 4,563,136.

In one type of gerotor pump or motor, fluid is conveyed to and from the gerotor gear set through a valve plate which has a circular array of openings therein. The valve plate and its circular array of openings rotates with the shaft and is disposed between the gerotor gear set and a commutator. The commutator has a circular array of inlet and outlet commutator openings. Rotation of the valve plate adjacent to the commutator causes the openings in the valve plate to pass adjacent to the inlet and outlet openings in the commutator creating fluidpaths from the openings in the commutator through the valve plate to the spaces between the teeth of the inner and outer gerotor gears. The inlet openings in the circular array of commutator openings alternate with the outlet openings. This alternating inlet and outlet arrangement together with the positioning of the commutator openings directs the proper flow of hydraulic fluid to and from the gerotor gear set. This type of gerotor hydraulic pump and motor with valve plate is described in U.S. Pat. Nos. 4,824,347; 4,699,577; and 4,813,856.

One of the difficult problems of gerotor type pumps and motors having valve plate and commutator directed fluid flow is that it is difficult to manufacture and assemble the commutator portion of the pump or motor. Moreover, regardless of the method of manufacture and assembly of the commutators in the past, the resulting fluid paths are relatively narrow creating a relatively large pressure drop in the hydraulic fluid as it moves through the pump or motor. Finally, one of the desired features for all pumps or motors of this type is a smaller size while maintaining a durable and strong construction. Improvements of these features have not been able to be achieved with the construction of the commutators as known in the prior art.

To achieve the construction of the prior art commutators having alternating inlet and outlet openings disposed in a circular array has required a difficult construction. First, an exterior housing piece is molded and machined with an opening for the shaft to extend axially therethrough. An inlet and outlet opening are provided on one side of the exterior housing piece and extend into the housing generally radially. A cylindrical cavity is provided in the exterior housing piece which extends coaxially with the shaft opening in the position desired for the commutator piece. The interior of this cylindrical cavity must be carefully machined to a precise size in order to receive a precisely sized commutator piece. The precisely sized commutator piece has the alternating inlet and outlet openings extending axially therethrough. This piece can be molded with this form and then machined to fit precisely within the cylindrical opening of the external piece of the housing. The commutator and housing pieces retain their precise assembled orientation by means of an irterference fit. This is accomplished by heating the external housing, precisely inserting the commutator piece and allowing the assembly to cool.

When subjected to extreme pressure or abusive conditions, the commutators of motors connected in accordance with the prior art can protrude from the housing since this connection is an interference fit. This protrusion can result in a loss of efficiency or even seizing of the motor.

To join the inlet and outlet paths of the external piece of the housing of the prior art with the axially extending commutator openings of the commutator piece, axially spaced annular openings are provided on the exterior of the commutator piece and the interior of the cylindrical opening which receives the commutator piece. Obliquely angled ports are drilled from the inlet and outlet ports of the exterior piece of the housing into the annular openings formed between the commutator piece and the external housing piece. These ports must be obliquely angled because the annular spaces are axially disposed with respect to each other preventing the annular openings from being directly beneath the inlet and outlet ports of the housing.

As described, the commutators of the prior art are difficult to manufacture because of the tortuous pathways therein. Moreover, this construction requires that the openings be relatively small. This combination produces a relatively high pressure drop as the fluid flows therethrough. This undesirable result is exaggerated if the size of the pump or motor is reduced.

SUMMARY OF THE INVENTION

It is accordingly an object of the present invention to achieve an improved gerotor-type hydraulic pump or motor of the type having a commutator with alternating inlet and outlet openings adjacent to a valve plate. It is particularly an object of the present invention to provide such a pump or motor with a commutator having a reduced pressure drop therethrough. Still further, it is a desire to provide such a commutator which is easier to manufacture, easier to assemble, more compact in design, less costly to produce and maintains strength and durability.

In accordance with these objects the present invention comprises an improved hydraulic pump or motor having a commutator with an inlet and outlet extending outwardly therein. The commutator has a plurality of alternating inlet and outlet commutator openings disposed in a circular array adjacent to a rotating valve plate which selectively communicates the inlet and outlet commutator openings with a rotating set of gerotor type gears. The commutator has a chambers section which includes the inlet and outlet for the pump or motor extending therein. The chambers section has a radially inner and a radially outer annular chamber formed therein. Each of these chambers is disposed radially beneath and connected to a selected one of the inlet and outlet ports. Each chamber is sealingly separated from the other.

The commutator also has a fluid pathways section disposed adjacent the chamber section. The pathways section includes the circular array of alternating inlet and outlet openings therein. This section is disposed adjacent to the rotating valve plate. The pathways section has fluid pathways therein which connect the inlet commutator openings to the annular chamber of the fluid carrying housing piece which is connected to the inlet port. The pathways section also has fluid pathways therein which connect the outlet commutator openings to the annular chamber which is connected to the outlet port.

Preferably, the pathways section comprises a plurality of flat plates each of which has openings therein and which are sealingly joined together such that the openings of the plates combine to form the pathways of the commutator. These plates can be made of metal and can be joined by brazing.

Also preferably the inlet and outlet ports are spaced approximately equal distances from and extend generally parallel to the pathways section. The radially inner and radially outer chambers extend radially beneath the inlet and outlet ports and vary in axial thickness to provide a separate connection to the inlet and outlet while maintaining a wide flow path to reduce pressure drop of fluid passing therethrough.

The plates of the pathways section preferably include a first, second and third plate. The first plate has a generally flat disc shape with a first set of transverse openings extending therethrough in fluid communication with the outer annular chamber of the chamber section of the commutator. A second set of transverse openings extend therethrough in fluid communication with the inner annular chamber of the chambers section of the commutator. The second plate also has a generally flat disc shape. The second plate has the circular array of alternating inlet and outlet openings extending therethrough which join with the openings of the valve plate to direct fluid flow to and from the gerotor gear set. The third plate also has a generally disc shape. The third plate has a first set of transverse openings extending therethrough which connect the first set of transverse openings of the first plate to a selected one of the inlet and outlet openings of the second plate. The third plate also includes a second set of transverse openings extending therethrough which connect the second set of transverse openings of the first plate to the other of the inlet and outlet openings of the second plate. In this manner, wide flowpaths can be created through the commutator. If the first, second and third plates all have the same thickness, it is necessary to provide additional plates of the same configuration as the third plate between the first and second plates so that a large flowpath can be achieved.

To achieve the maximum width of the flowpaths through the commutator, the second set of openings in the first plate must be disposed radially inwardly and generally circumferentially spaced between the first set of openings in the first plate. The first set of transverse openings in the third plate must have a t-shape with a portion thereof extending radially between the openings of the second set of openings in the third plate. This arrangement converts the radially inner and outer positions of the openings in the first plate to a circular array of alternating inlet and outlet openings in the third plate with maximum volume flowpaths therebetween.

For a further understanding of the invention and further objects, features and advantages thereof, reference may now be had to the following description taken in conjunction with the accompanying drawings.

DESCRIPTION OF PREFERRED EMBODIMENTS

Figure 1:
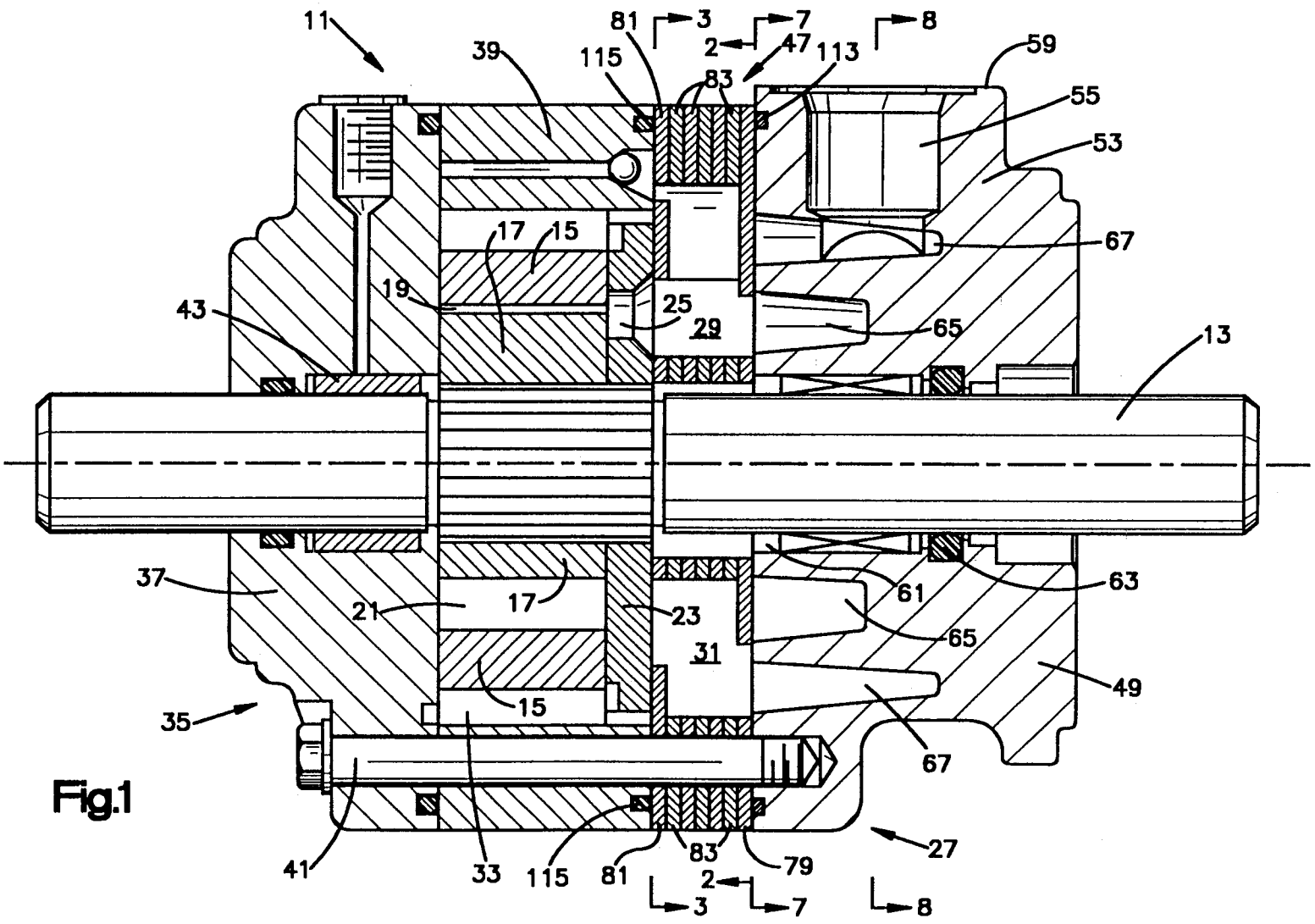
FIG. 1 is a cross-sectional view of a pump or motor constructed in accordance with the present invention taken along the lines shown in FIG. 7.

Referring now to FIG. 1, a device constructed in accordance with the present invention is shown at 11. Devices using the concepts of the present invention can be either hydraulic pumps or motors depending on the desired purpose and the details of design. The device 11 is a motor which uses the flow of hydraulic fluid to drive the rotation of a shaft 13. The power elements which drive the shaft 13 are a set of gerotor gears 15 and 17.

The operation of gerotor-type motors requires that hydraulic fluid be delivered to and exit from displacement chambers such as 19 and 21 which are formed between the inwardly facing teeth of the outer gear 15 and the outwardly facing teeth of the inner gear 17. High pressure fluid which enters the displacement chambers 19 and 21 urges the chambers to increase in volume. This powers the rotation of the gear 17 and the shaft 13 to which gear 17 is attached. Low pressure hydraulic fluid must exit the displacement chambers 19 and 21 as they decrease in volume.

In all gerotor motors and pumps, one of the gerotor gears must have a different axis than the other so that the increasing and decreasing displacement chambers can be formed between the internal gear teeth as one of the gears rotates about its axis. In the simplest gerotor pumps and motors, the inner gear rotates about the same axis as the shaft and the outer gear rotates about an offset axis. In this type of motor or pump the inlet is fixed on one side of the pump or motor and the outlet is fixed on the other side. The present invention is not used with this type of motor or pump. The present invention is adapted for use in the type of gerotor pump or motor in which one of the gears orbits in order to multiply the number of increasing and decreasing displacement chambers per shaft revolution. An example of such a device in which the outer gear is fixed and the inner gear orbits and rotates is shown in U.S. Pat. No. 4,699,577. An example of such a device in which the inner gear rotates and the outer gear orbits is shown in U.S. Pat. No. 4,813,856. The device shown in FIG. 1 is of the latter type.

In gerotor pumps and motors of the type having an orbiting inner or an orbiting outer, the inlet can not be fixed on one side of the motor and the outlet can not be fixed on the other side of the motor. This is because the displacement chambers in motors with orbiting elements do not go through a cycle of minimum-to-maximum-to-minimum volume in 360 degrees. Therefore, the inlets and outlets must "follow" the displacement chamber cycle established by the number of inner or outer gear orbits per output shaft revolution.

Figure 3:
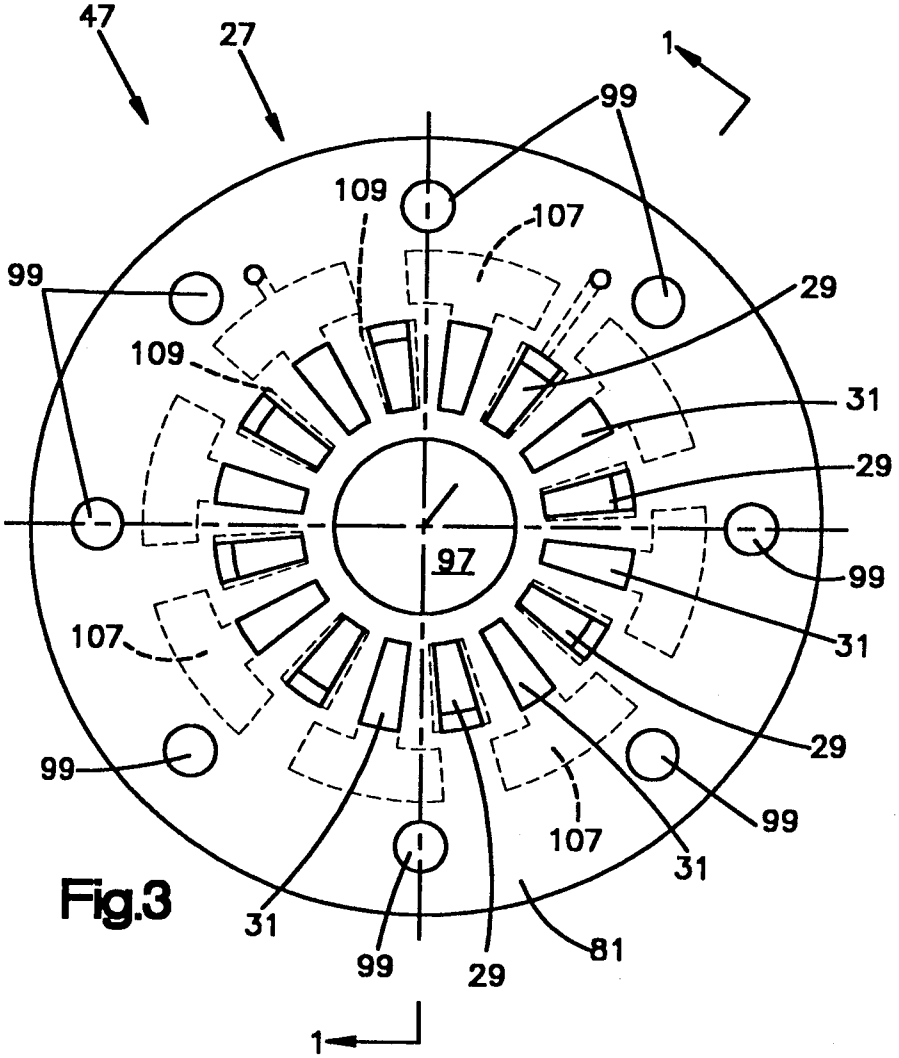
FIG. 3 is a side view of the plate assembly of FIG. 1 taken along the lines shown in FIG. 1.

Referring now to FIGS. 1 and 3, it can be seen that a valve plate 23, which rotates with the shaft 13 adjacent to the gerotor gears 15 and 17, has ports 25 which serve as inlets and outlets for the displacement chambers between the gerotor gears 15 and 17. Each of the displacement chambers has corresponding port 25 adjacent to it in valve plate 23. Adjacent to valve plate 23, opposite the gerotor gears 15 and 17, is a commutator 27. The commutator 27 has a circular array of alternating inlets 29 and outlets 31 disposed to selectively mate with the ports 25 of the valve plate 23 as the valve plate 23 rotates adjacent to the commutator 27.

As the valve plate 23 rotates, each port 25 passes adjacent to inlets 29 and outlets 31. As a port 25 passes from an inlet to an outlet and then back to an inlet, the displacement chamber adjacent to that port 25 moves through its cycle of minimum-to-maximum-to-minimum volume. In this manner, the valve plate 23 and the circular array of alternating inlets and outlets in the commutator allow the inlets and outlets to follow the displacement chamber cycle.

The gerotor gears 15 and 17 as well as the valve plate 23 move within a cavity 33 in a housing 35. The housing 35 is formed of the commutator 27, a housing end piece 37, and an annular housing spacer 39. The housing 35 is generally cylindrical in shape and bolts 41 are regularly spaced about the periphery of the cylindrically shaped housing 35 to hold it together. The bolts 41 extend through the end piece 37 and the spacer 39 and are threaded into the commutator 27. The shaft 13 extends axially through the housing 35 with bearings 43 and 45 retaining the shaft 13 for rotation therein. Bearing 43 is disposed in end piece 37 and bearing 45 is disposed in commutator 27.

The improvement of the present invention resides in the commutator 27. The construction of the valve plate 23, the gerotor gears 15 and 17, the end piece 37, the spacer 39 and the shaft 13 is conventional. Reference may be made to U.S. Pat. No. 4,813,856 for further details about the construction, arrangement and operation of these elements.

The improved commutator 27 of the present invention includes a fluid pathways section 47 and an annular chambers section 49. These elements are shown in FIGS. 1–10. FIGS. 2–6 are various views of the fluid pathways section 47 and FIGS. 7–10 are various views of the annular chambers section.

The annular chambers section 49 is a generally cylindrical piece of molded metal with a flat face 51 at one end thereof. This face 51 is shown in hatched line in FIG. 7. The shaft 13 extends axially through the center of the annular chambers section 49 and the face 51 extends transversely thereto.

Extending across the top of the annular chambers section 49 is a raised inlet and outlet platform 53. A threaded inlet 55 and a threaded outlet port 57 extend downwardly through the raised platform 53.

The upper surface 59 of the platform 53 extends parallel to the shaft 13 and transversely to the face 51 of the annular chambers piece 49. The inlet port 55 and the outlet port 57 extend downwardly at right angles to the upper surface 59 of the raised platform 53. The inlet port 55 and outlet port 57 are spaced from each other and are approximately the same distance from the face 51.

The shaft 13 extends through a cylindrical shaft opening 61 at the axial center of the annular chambers piece 49. Bearing 45 and seal 63 reside in the opening 61. Extending concentrically about the opening 61, radially beneath the inlet port 55 and the outlet port 57 are an inner annular chamber 65 and an outer annular chamber 67. The outer annular chamber 67 is connected to the inlet port 55 and the inner annular opening 65 is connected to the outlet port 57.

The inlet port 55 extends directly downwardly (perpendicularly to the surface 59 of the raised platform 53) into the outer annular chamber 67. In order for the outlet port 57 to also extend directly downwardly into the inner annular chamber 65, the outer annular chamber 67 must be axially thinner or narrower beneath the outlet port 57.

Figure 7:
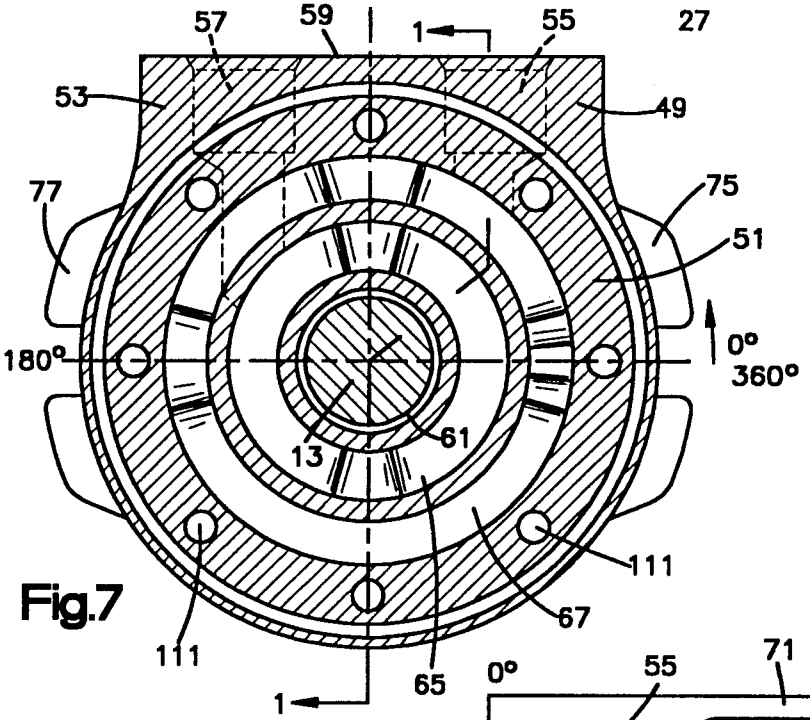
FIG. 7 is a cross-sectional view of the device shown in FIG. 1 taken along the lines shown in FIG. 1.
Figure 9:
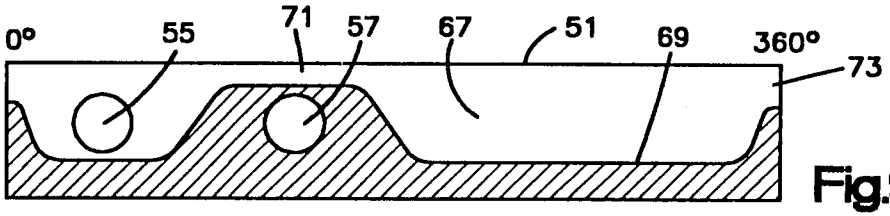
FIG. 9 is a cylindrical cross-sectional view of the device shown in FIG. 7.
Figure 10:
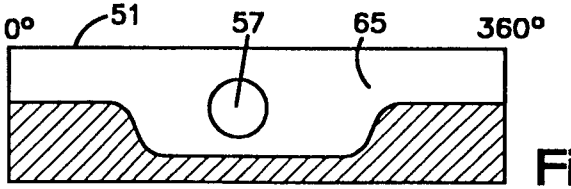
FIG. 10 is a cylindrical cross-sectional view of a portion of the device shown in FIG. 7.

FIG. 9 is a sectional view of the chambers section 49 taken concentrically through the center of the outer annular chamber 67 and FIG. 10 is a sectional view of the chambers section 49 taken concentrically through the center of the inner annular chamber 65. The position and direction of the sectional views of FIG. 9 and FIG. 10 are shown in FIG. 7. The view in both cases is radially outwardly.

As can be seen in FIG. 9, the axial thickness of the outer annular chamber 67 (the distance from the back 69 of the chamber 67 to the face 51 of the chambers section 49) is reduced adjacent the outlet port 57 in order to avoid the outlet port 57. This narrowed portion 71 allows the outer annular chamber 67 to avoid fluid communication with the outlet port 57 while providing a maximum flow path to the inlet port 55 and throughout the outer annular chamber.

A second narrowed portion 73 of the outer annular chamber 67 is provided for structural integrity near a mounting flange 75. The mounting flange 75 extends radially outwardly from the chambers section 49 and is axially outboard of the ports 55 and 57. The narrowed portion 71 also provides structural integrity near the mounting flange 77 extending radially from the chambers section 49 opposite the flange 75.

The inner annular chamber 65 is somewhat axially thinner or narrower than the annular chamber 67 except adjacent the opening of outlet port 57. The narrower chamber 67 provides a stronger chamber section 49 while maintaining a low pressure drop therethrough. The wider portion adjacent the outlet port 57 provides for the connection to the outlet port 57 and a good fluid flow throughout the chamber 65.

The inner annular chamber 65 and the outer annular chamber 67 both gradually increase in radial width from the back toward the face 51. They both extend into the face 51 forming annular openings at the face 51. This structure provides good fluid flow and allows the chamber section 49 of the commutator 27 to be molded with the chambers 65 and 67 therein.

The chambers section is preferably formed of a strong, moldable and machinable metal such as cast iron. After the molding of the chambers section 49 with the chambers 65 and 67 therein, the inlet port 55 and the outlet port 57 can be machined to provide the connections to the chambers 65 and 67. In addition, the face 51 can be machined flat to provide a good sealing surface. Thus the chambers section 49 can be formed with low cost, simple procedures.

Figure 4:
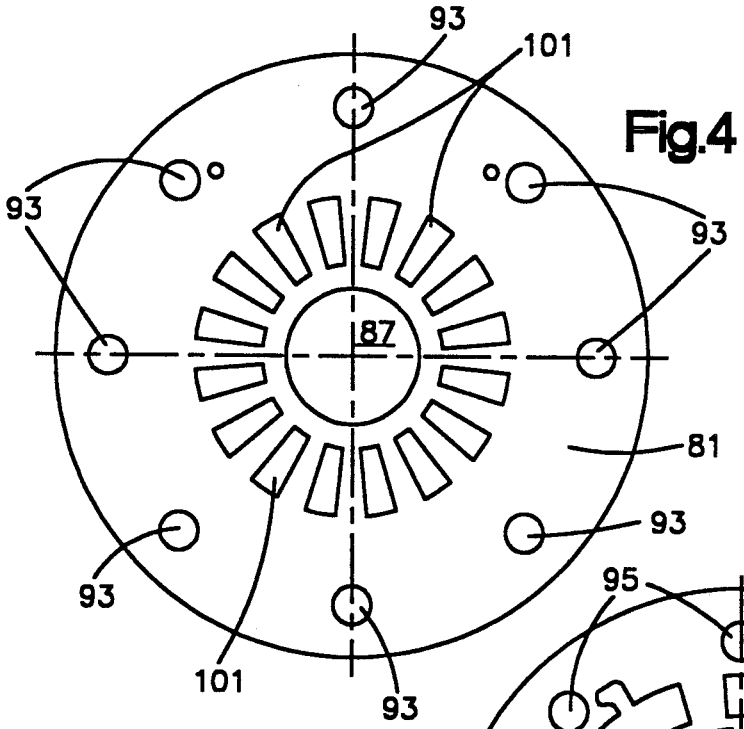
FIG. 4 is a side view of a plate shown in FIG. 3.
Figure 5:
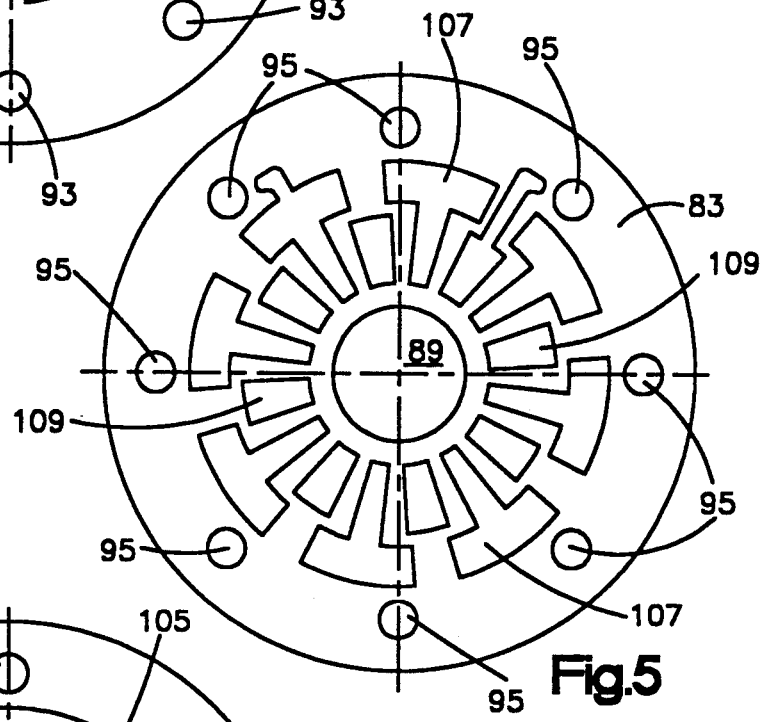
FIG. 5 is a side view of a plate of the plate assembly shown in FIG. 1.
Figure 6:
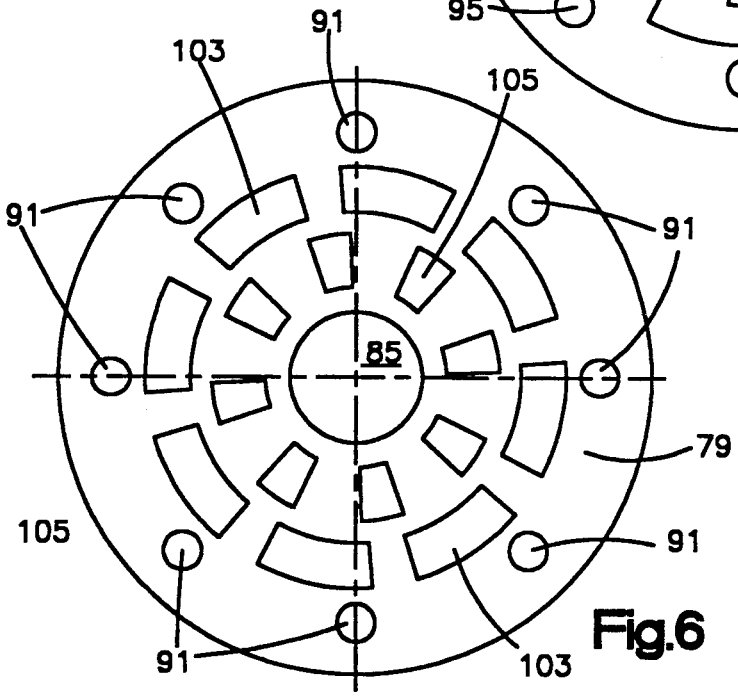
FIG. 6 is a side view of a plate shown in FIG. 2.
Figure 8:
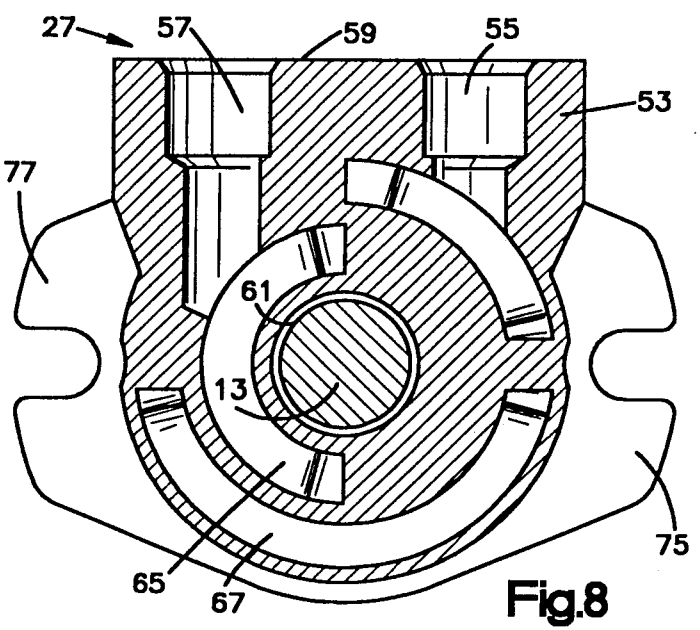
FIG. 8 is a cross-sectional view of the device shown in FIG. 1 taken along the lines shown in FIG. 1.

The pathways section 47 of the commutator 27 is formed of seven relatively thin disk-shaped plates having three different configurations. The first is shown in FIG. 6, the second is shown in FIG. 4 and the third is shown in FIG. 5. Each of these plates is radially continuous and relatively thin—for example, 0.070 inches thick. By radially continuous it is meant that each plate is formed of a single piece which is not broken in the radial direction. Each of the plates is preferably of a strong metal such as steel. When sealing joined together, the plates form a generally cylindrical shape approximately 0.5 inches thick. The preferred method of sealingly joining the plates is by brazing.

Figure 2:
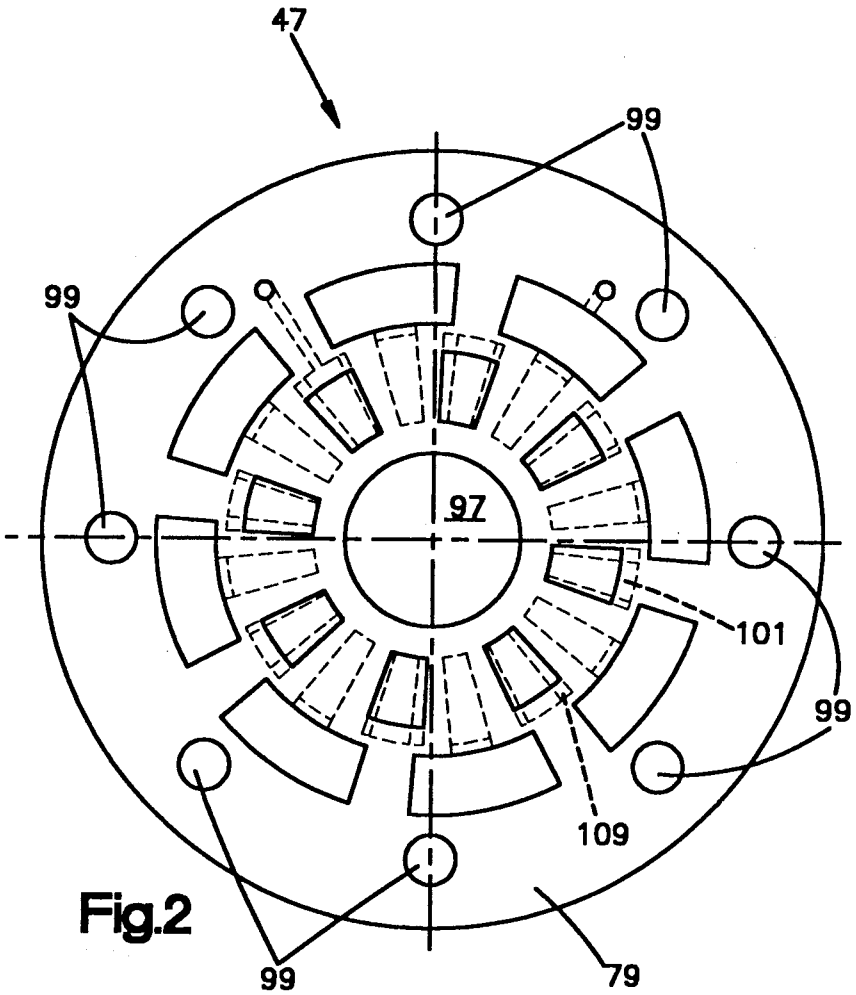
FIG. 2 is a side view of the plate assembly shown in FIG. 1 taken along the lines shown in FIG. 1.

Each of the plates 79, 81 and 83 have a circular shaft opening at their axial center. Opening 85 is provided in plate 79, opening 87 is provide in plate 81, and opening 89 is provided in plate 83. Each of the plates 79, 81 and 83 also have eight bolt openings regularly spaced about the periphery of the circular disc shape of the plates and extending transversely through the plates. Bolt openings 91 are provided in plate 79, bolt openings 93 are provided in plate 81 and bolt openings 95 are provided in plate 83. When the plates are joined together the central openings and the bolt openings align to form a common central openings 97 and common bolt openings 99 shown in FIGS. 2 and 3. FIGS. 2 and 3 show the plates after assembly to form the pathways section 47 with the underlying openings shown in dotted line. FIG. 2 shows the pathways section from the right as shown in FIG. 1 and FIG. 3 shows the pathways section 47 from the left as shown in FIG. 1.

Plate 81 has a circular array of generally rectangular openings 101 extending transversely therethrough. More precisely, the rectangular openings are annular segments with radially extending sides. This circular array of openings 101 is centered on the axis of the plate 81 and forms the alternating inlet and outlet openings 29 and 31 shown in FIG. 3.

Plate 79 has an outer circular array of generally rectangular openings 103 and an inner circular array of generally rectangular openings 105 extending therethrough. The openings 103 are shaped and disposed so that they are adjacent portions of the chamber 67 when the plates are assembled with the chamber section 49 of the commutator 27. The openings 105 are shaped and disposed so that they are adjacent portions of the chamber 65 when the plates are assembled with the chamber section 49. The openings 103 are disposed radially outside of the openings 105. The openings 105 are generally centered between each of the openings 103. In addition, a center line extending radially through the center of an opening 105 will also extend through the center of the land between openings 103 between which it is centered.

The plate 83 has a first set of generally t-shaped openings 107 which extend in a circular array about the center of the disc 83. A second set of rectangular shaped openings 109 are disposed in a circular array between each of the lower portions of the openings 107. Each of the openings 107 and 109 extend transversely through the plate 83.

As shown in FIGS. 2 and 3, assembly of the plates to form the pathways section 47 is achieved by sandwiching five of the plates 83 between the plates 81 and 79. Each of the plates 83 is aligned so that the openings therein match to form a common central fluid pathway. The plate 79 is aligned with the plates 83 so that the outer openings 103 are disposed in line with the outer portion of the t-shaped openings 107. In addition, the inner openings 105 are disposed in line with the openings 109 of plate 83.

Plate 81 is aligned so that the openings 101 extend alternately in line with the openings 109 of plate 83 and the lower portion of the t-shaped openings 107 of plate 83. Each of the plates 79, 81, and 83 can be made by fine blanking or stamping the openings into blank disks. Since plate 79 requires more precise positioning of its openings, fine blanking is preferred for forming this piece.

After the alignment of the plates 79, 81 and 83 to form the pathways section 47 of the commutator 27, these plates must be sealed so that the aligned openings therein can form fluid pathways. The preferred method of this sealing is by brazing. Thus, during the process of joining the plates, brazing wire can be added to the sides and internal cavities of the plates where contact will occur and then the entire combination can be brazed to form a single pathways section 47.

Although not as easy to manufacture, the pathways section 47 can be formed without brazing. In this configuration, the five middle plates 83 can be replaced with a single thick plate having o-ring grooves therein. The o-ring grooves could accommodate o-rings which would seal the exterior of plates 79, 81 and 83 similar to o-rings 113 and 115.

Following assembly of the plates 79, 81 and 83, it can seen that the pathways section 47 combines sealingly with the chamber section 49 to direct the fluid flow to and from the inner and outer annular chambers 65 and 67 to and from a circular array of alternating inlet and outlet openings 29 and 31 adjacent the rotating valve plate 23. To assemble the motor 11, bolts 41 are extended through the end piece 37, the spacer 39, the bolt openings of each of the plates of the fluid pathways section 47 and are threaded into the threaded bolt openings 111 provided in the chamber section 49. O-rings 113 and 115 are provided in the chamber section 49 and the spacer 39, respectively to seal the connection with the pathways section 47. After assembly the openings 25 in the valve plate 23 rotate adjacent the alternating inlet and outlet openings 29 and 31 in a conventional manner.

As can be seen, the commutator 27 formed in accordance with the concepts of the present invention produces the alternating inlet and outlet circular array of openings from the inlet 55 and outlet 57 in a small space. In addition, the fluid pathways are wider and less tortuous than in prior art commutators. Still further, the commutator 27 of the present invention is more easily constructed and has higher strength and durability.

Motors constructed in accordance with the present invention typically have a size measured in displacement per shaft revolution. This means of measuring determines the size of the motor since the strength of materials and other factors then constrain the arrangement and size of the parts. Thus, popular motor displacements of the present invention range in size from about 3 cubic inches per shaft revolution to about 24 cubic inches per shaft revolution and would have an outside diameter of up to approximately 4.5 inches. The power element in a 3 cubic inch per shaft revolution motor would be approximately 0.3 inches in axial length and the power element in a 24 cubic inch per shaft revolution motor would be about 2.6 inches in axial length.

Regardless of size the commutator constructed in accordance with the present invention produces a much lower pressure drop through the commutator and motor when compared to conventional motors. Thus, in a mid-sized motor having 8.8 cubic inches per shaft revolution, a motor with a commutator constructed in accordance with the present invention will have a no-load pressure drop of approximately 600 psi when driven at 40 gallons per minute. Such a motor constructed in accordance with the prior art would have a pressure drop of approximately 1200 psi at the same speed. Thus, the pressure drop is improved by a factor of 2.

Although the smallest motors utilizing the commutator of the present invention do not show quite as large an improvement, generally the pressure drop through the motor is halved when compared with the motors having prior art type commutators. Thus, the present invention produces a startlingly improved motor when compared to the motors of the prior art.

It is also apparent that the present invention eliminates precise grinding and assembly steps. This reduces cost. In addition, the invention provides a stronger and more reliable device because of the orientation of the pieces. Improved radial strength as a result of single axial pieces balances radial stresses or loads and some axial stresses or loads are reduced or eliminated.

Thus, the improved hydraulic pump or motor of the present invention is well adapted to achieve the objects and advantages mentioned, as well as those inherent therein. While presently preferred embodiments of the present invention have been described for the purpose of this disclosure, numerous changes in the construction and arrangement of parts can be made by those skilled in the art, which changes are encompassed within the spirit of this invention as defined by the appended claims.

The foregoing disclosure and the showings made in the drawings were merely illustrative of the principles of this invention and are not to be interpreted in a limiting sense.

What is claimed is:

1. An improved hydraulic pump or motor of the type having a commutator with an inlet port and outlet port therein connected, respectively, to a plurality of alternating inlet and outlet commutator openings formed in the commutator and disposed in a circular array adjacent to a rotating valve plate disposed between said commutator and a rotating set of gerotor-type gears and which selectively communicates said inlet and outlet commutator openings with a said rotating set of gerotor-type gears, the improvement comprising:

said commutator comprising a chamber section which includes said inlet and said outlet extending radially outwardly therein; said chamber section having a face with a planar portion having hollow concentric chambers formed therein including a radially inner and a radially outer annular chamber each of which is connected to a selected one of said inlet and outlet; and said commutator also comprising a pathways section disposed adjacent and in sealing relation with said face of said chamber section and having said plurality of inlet and outlet commutator openings therein; said pathways section having fluid pathways therein which connect said inlet commutator openings to said annular chamber of said chamber section which is connected to said inlet port, and which connect said outlet commutator openings to said annular chamber which is connected to said outlet port.

2. The improved hydraulic pump or motor of claim 1 wherein said pathways section of said commutator comprises a plurality of relatively thin plates each of which has openings therein and which are sealingly joined together such that said openings of plates combine to form said pathways of said commutator.

3. The improved hydraulic pump or motor of claim 2 wherein said plates are made of metal and are joined together by brazing.

4. The improved hydraulic pump or motor of claim 2 wherein said inlet port and said outlet port are disposed radially outwardly from said inner and outer annular chambers.

5. The improved hydraulic pump or motor of claim 4 wherein each of said radially inner and radially outer chambers extend radially beneath said inlet and outlet except that said radially outer chamber of said chamber section has an axially thin portion to allow said connection of said radially inner chamber to the selected one of said inlet port and outlet port.

6. The improved hydraulic pump or motor of claim 2 wherein said plates include:

a first plate having a generally flat disc shape with a first set of transverse openings extending therethrough in fluid communication with said outer annular chamber of said chamber section of said commutator and a second set of transverse openings extending therethrough in fluid communication with said inner annular chamber of said chamber section of said commutator;

a second plate having a generally flat disc shape with said circular array of said alternating inlet and outlet openings extending therethrough; and a third plate having a generally disc shape with a first set of transverse openings therethrough which connect said first set of transverse openings of said first plate to a selected one of said inlet and outlet openings of said second plate, and a second set of transverse openings extending therethrough which connect said second set of transverse openings of said first plate to the other of said inlet and outlet openings of said second plate.

7. The improved pump or motor claim 6 wherein each of said second set of openings of said first plate is disposed radially inwardly and generally circumferentially between the openings of said first set of openings in said first plate.

8. The improved hydraulic pump or motor of claim 7 wherein said first set of transverse openings of said third plate have a t-shape with a portion thereof extending radially between the openings of said second set of openings in said third plate.

9. The improved hydraulic pump or motor of claim 6 wherein said second plate is radially continuous and formed of metal.

10. The improved hydraulic pump or motor of claim 1 wherein said chamber section comprises a molded metal, generally cylindrical piece having said face at one end thereof, said radially inner and radially outer annular chambers extending into said face and forming annular openings therein.

11. The improved hydraulic pump or motor of clam 10 wherein said pathways section of said commutator has a generally cylindrical shape one end of which has a flat face thereon which mates with said face of said chamber section of said commutator.

12. The improved hydraulic pump or motor of claim 11 wherein said pathways section of said commutator comprises a plurality of relatively thin plates each of which has openings therein and which are sealingly joined together such that said openings of plates combine to form said pathways of said commutator.

* * * * *